US007726549B2

(12) United States Patent
Lo Duca

(10) Patent No.: US 7,726,549 B2
(45) Date of Patent: Jun. 1, 2010

(54) BOX WITH INTERNAL POCKET FOR EXTRACTABLE LEAFLET

(75) Inventor: Carmelo Lo Duca, Milan (IT)

(73) Assignee: GI.BI.EFFE S.r.l., Milan (IT)

( * ) Notice: Subject to any disclaimer, the term of this patent is extended or adjusted under 35 U.S.C. 154(b) by 7 days.

(21) Appl. No.: 11/622,724

(22) Filed: Jan. 12, 2007

(65) Prior Publication Data

US 2007/0199982 A1 Aug. 30, 2007

(30) Foreign Application Priority Data

Feb. 27, 2006 (IT) ..... MI2006A0342

(51) Int. Cl.
*B65D 5/486* (2006.01)
*B65D 25/04* (2006.01)

(52) U.S. Cl. ..... 229/120.18; 206/232; 229/120.11

(58) Field of Classification Search ..... 206/232, 206/831; 229/120.18, 120.11, 120.15, 122.32, 229/153

See application file for complete search history.

(56) References Cited

U.S. PATENT DOCUMENTS

| | | | | |
|---|---|---|---|---|
| 3,147,856 A | | 9/1964 | Lightner et al | |
| 3,533,546 A | * | 10/1970 | Kossnar | 229/162.1 |
| 4,134,495 A | * | 1/1979 | Friedman | 206/387.11 |
| 5,513,752 A | | 5/1996 | Gottlieb | |
| 5,944,183 A | * | 8/1999 | Rowland et al. | 206/313 |
| 5,971,856 A | * | 10/1999 | Aoyama et al. | 463/43 |
| 6,702,108 B2 | | 3/2004 | Lo Duca | |
| 6,923,315 B2 | | 8/2005 | Lo Duca | |
| 6,923,366 B2 | | 8/2005 | Lo Duca | |
| 7,036,715 B2 | * | 5/2006 | Lo Duca | 229/120.18 |
| 2004/0011859 A1 | | 1/2004 | Lo Duca | |
| 2004/0020977 A1 | | 2/2004 | Lo Duca | |

FOREIGN PATENT DOCUMENTS

| | | |
|---|---|---|
| DE | 26 38 979 | 3/1978 |
| DE | 32 08 777 A1 | 9/1983 |
| DE | 299 01 874 U1 | 4/1999 |
| EP | 0 911 266 A2 | 4/1999 |
| EP | 1 321 369 A1 | 6/2003 |
| EP | 1 346 922 A1 | 9/2003 |
| EP | 1 371 565 A2 | 12/2003 |
| EP | 1 380 512 A1 | 1/2004 |
| EP | 1 386 845 A1 | 2/2004 |
| GB | 2 277 077 A | 10/1994 |

OTHER PUBLICATIONS

U.S. Appl. No. 11/622,724, filed Jan. 12, 2007, LoDuca.

* cited by examiner

*Primary Examiner*—Gary E Elkins
(74) *Attorney, Agent, or Firm*—Oblon, Spivak, McClelland, Maier & Neustadt, L.L.P.

(57) ABSTRACT

A box formed from a single piece of cardboard or the like having an internal panel defining within the box an internal pocket for housing an extractable leaflet or the like, this internal panel being situated in proximity to that box main panel which is parallel to but distinct from that from which the box lid extends.

3 Claims, 4 Drawing Sheets

BOX WITH INTERNAL POCKET FOR EXTRACTABLE LEAFLET

FIELD OF THE INVENTION

The present invention relates to a box having in its interior a pocket for housing and retaining an illustrative leaflet, the pocket being defined in the box interior by a panel situated in front of that panel from which the box lid projects, so making it considerably more simple to introduce the product into the box which is to contain it. The term "illustrative leaflet" means any sheet, possibly folded several times on itself, carrying writing and instructions relative to the product contained in the box, or a card extractable from the pocket and having images or writing of any type reproduced on it, or a blister sheet overwrapper or protector for housing blister sheets containing pills, tablets, capsules and the like.

BACKGROUND OF THE INVENTION

Boxes in which products of various kinds are housed, preserved and transported also very often contain inserted illustrative leaflets, blister sheet protectors or the like. A frequent example is that in which the articles inserted into the boxes are containers of various kinds, bottles of various materials, or flat packs defining a plurality of recesses containing capsules or tablets of pharmaceutical products (commonly known as blister packs): in this case, a leaflet illustrating the pharmaceutical product must compulsorily be present in the actual box into which the bottle, container or the like is inserted.

In the usual known art, the boxes are produced by specialist firms, whereas the bottles or the like together with the relative illustrative leaflets are inserted therein in a subsequent step by the packaging firm: this operation is relatively laborious and slow, especially as a result of the difficulties encountered in inserting the leaflet (often of large dimensions and folded over several times) into the box in such a manner that it still allows the bottle or pack to be freely inserted without the leaflet becoming creased.

DESCRIPTION OF RELATED ART

To obviate these problems boxes have been proposed formed from a single piece of cardboard and defining in their interior a pocket into which the illustrative leaflet is inserted directly by the manufacturer of the box, the user of which (i.e. the packaging firm) has then merely to insert the articles (bottles, blister packs or others) which the box is to contain.

The leaflet must be retained safely inside each box such that it does not interfere with the article inserted (by automatic machines operating at high speed) into the box by the packaging firm.

GB-A-2277077 (see FIGS. 3 and 4) and DE-A-3208777 (see FIG. 2) describe boxes, into the interior of which there projects a freely rotatable panel which on one of its sides is rigid with one of the main side walls of the box, this panel facing a different main wall of the same box to form therewith a pocket housing the illustrative leaflet, this panel being freely rotatable and hence preventing or hindering automatic introduction of any article into the box.

U.S. Pat. No. 3,147,856 (FIG. 3) and EP-A-0911266 (FIG. 2) describe boxes similar to those of the two aforementioned patents, but in which the flap defining the pocket in the box interior has its free end folded at 90° about itself to form a tab which is glued to the adjacent main side wall of the box, said flap dividing the box cavity into two longitudinal parts and having its free edge which is straight and parallel to the adjacent free edge of the outer box panel defining the pocket for housing the illustrative leaflet, hence interfering with any article to be automatically introduced into it, just as occurs with the box described in EP-A 0911266.

An improved type of box with an internal pocket for an illustrative leaflet is described in U.S. Pat. No. 5,513,752 and U.S. Pat. No. 6,702,108 B2 and in the corresponding EP-B-1321369; U.S. Pat. No. 6,923,315 B2 and in the corresponding EP-B-1346922; U.S. Pat. No. 6,923,366 B2 and in the corresponding EP-A-1371565; in U.S. 2004/0011859 A1 and in the corresponding EP-1380512 A1; and in EP 1386845 A1 and U.S. 2004/0020977, all in the name of the present applicants.

The illustrative leaflet is inserted into these boxes directly by the box producer, so that the user firm has merely to introduce therein the product which the box is to contain.

One of the problems to be confronted derives from the fact that the illustrative leaflet is often very large and has to be folded several times about itself to assume a shape enabling it to be contained and enclosed in the respective box: if the leaflet is very large it can also assume a very large thickness after folding, meaning that the box pocket into which the folded leaflet is to be inserted and preserved must be of considerable height or thickness, possibly leading to considerable problems when the products to be contained are introduced (by automatic machines operating at high speed).

In all the boxes illustrated in the many aforesaid prior patents in the name of the present applicants, the illustrative leaflets are inserted into pockets bounded outwards by that main panel of each box from which the closure panel projects to form closure lid for that box end through which the product to which the illustrative leaflet refers is introduced. Many types of automatic machines exist for introducing said products into the box. In those cases in which the product is introduced after resting the box on its rear with its closure panel (or lid) completely open and resting on a support surface of the automatic machine, the product to be packaged is introduced by sliding it along the inner surface of the closure panel until it penetrates into the box interior (with its lid open): with the boxes of known type illustrated in the aforesaid patents in the name of the present applicant, the products introduced by automatic machines must evidently slide over and beyond the adjacent edge of the pocket in which the illustrative leaflet folded about itself is already housed. If the leaflet is very large, it requires or induces a considerable space between the box inner wall and that wall which rests on the machine working surface, so largely hindering or even preventing product introduction through the open lid of the box.

To obviate the aforesaid drawbacks, the said U.S. Pat. No. 6,923,366 B, U.S. 2004/0011859A, U.S. 2004/0020977A and EP1386845 describe boxes having an internal pocket defined by an internal panel in each box, from the ends of this internal panel there projecting a lip which rests on the box end or closure panel to form a chute which facilitates introduction of the products into the box which is to contain them: these boxes with an introduction lip or chute also present problems deriving from the fact that this lip tends (because of the elasticity of the cardboard sheet from which it has been punched) to rotate towards the box interior and hence to hinder or impede automatic introduction of said products into it.

SUMMARY OF THE INVENTION

The main object of the present invention is to provide a box formed from a single piece of cardboard or the like, in which the pocket intended to contain the illustrative leaflet or the like is positioned in proximity to that box main wall which is parallel and opposite to that wall from which the box closure panel or lid projects. In this manner the product can be inserted into the box by siding it (without it encountering obstacles or steps) along the inner surface of the box closure panel (completely open and extended) and along the inner surface (distant from said pocket) of that box panel from which said closure panel projects. The invention also relates to the piece of punched and crease-lined cardboard or the like from which the said box can be formed.

It has however been found that if the product is to be introduced mechanically at high speed into the box (with its closure panel pressed open), this product (for example a bottle or a pack consisting of a plurality of superposed blister sheets) can strike violently against the free (entering) edge of the panel defining the pocket inside the box, hence damaging the box and product and interrupting regular operation of the automatic machine feeding the product into the box.

Another object of the present invention is therefore to form (from a single piece of punched and crease-lined cardboard) a box provided with an internal pocket defined by a panel inside the box, in which the free edge of this panel is inclined or curved relative to the adjacent free edge of the box external panel with which it defines said pocket, such as to facilitate introduction of the product into the box which is to contain it.

BRIEF DESCRIPTION OF THE DRAWINGS

A description of two boxes according to the invention is given hereinafter by way of non-limiting example with reference to the accompanying drawings, in which.

Figure 1:
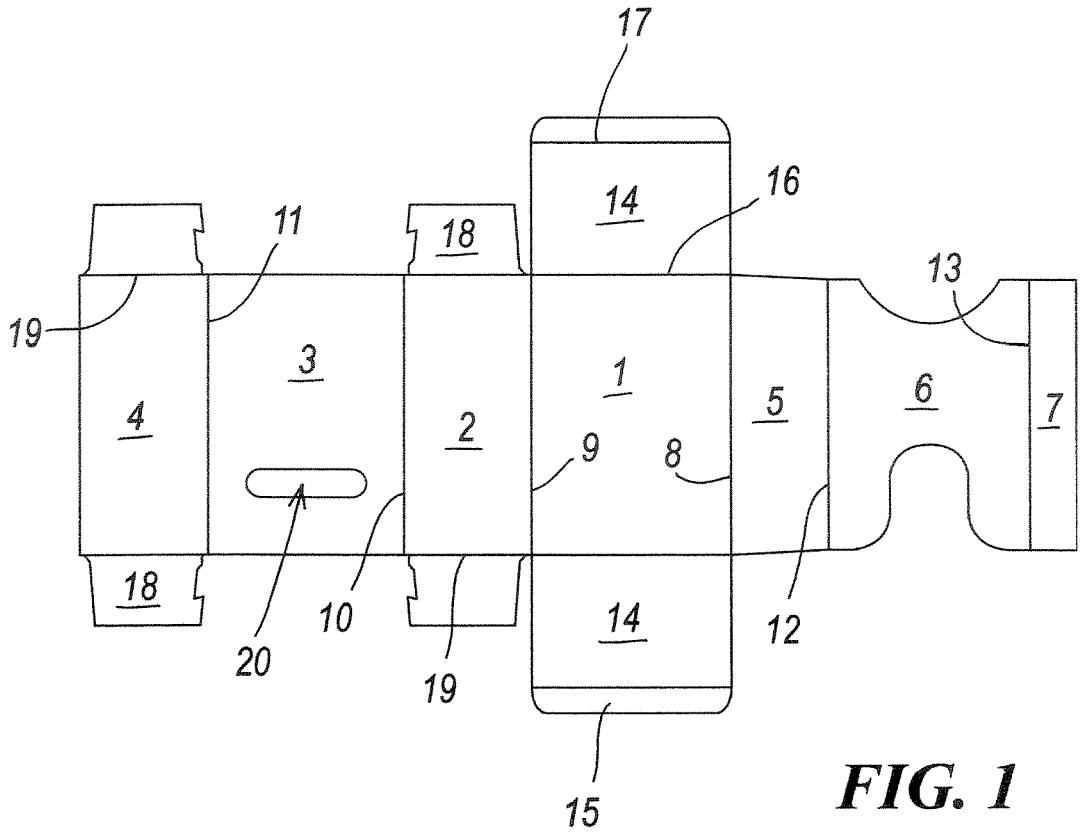
FIG. 1 is a plan view of a spread-out punched and crease-lined piece of cardboard usable for forming a box.
Figure 7:
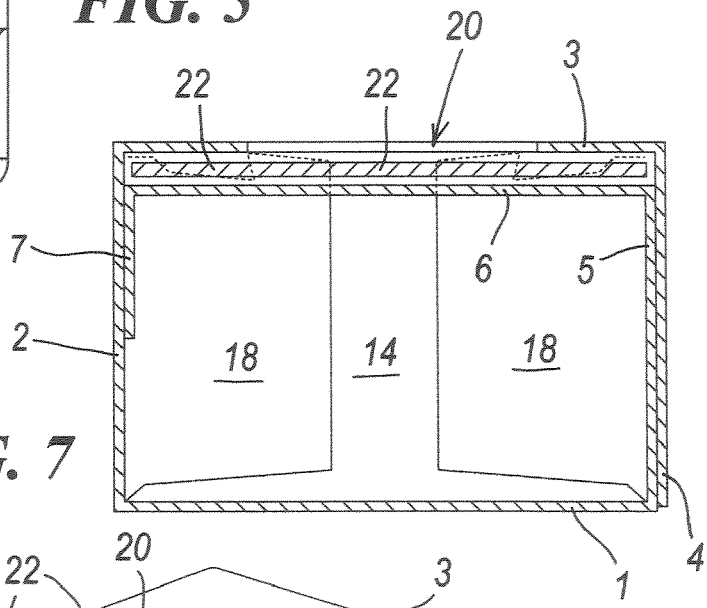
Figure 6:
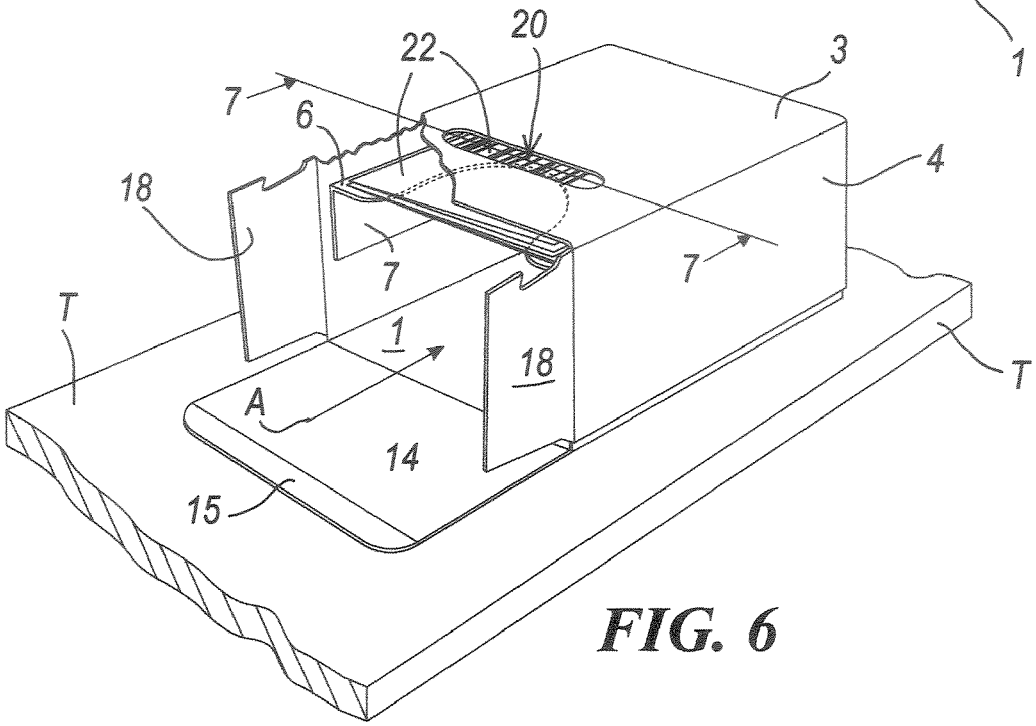
Figure 8:
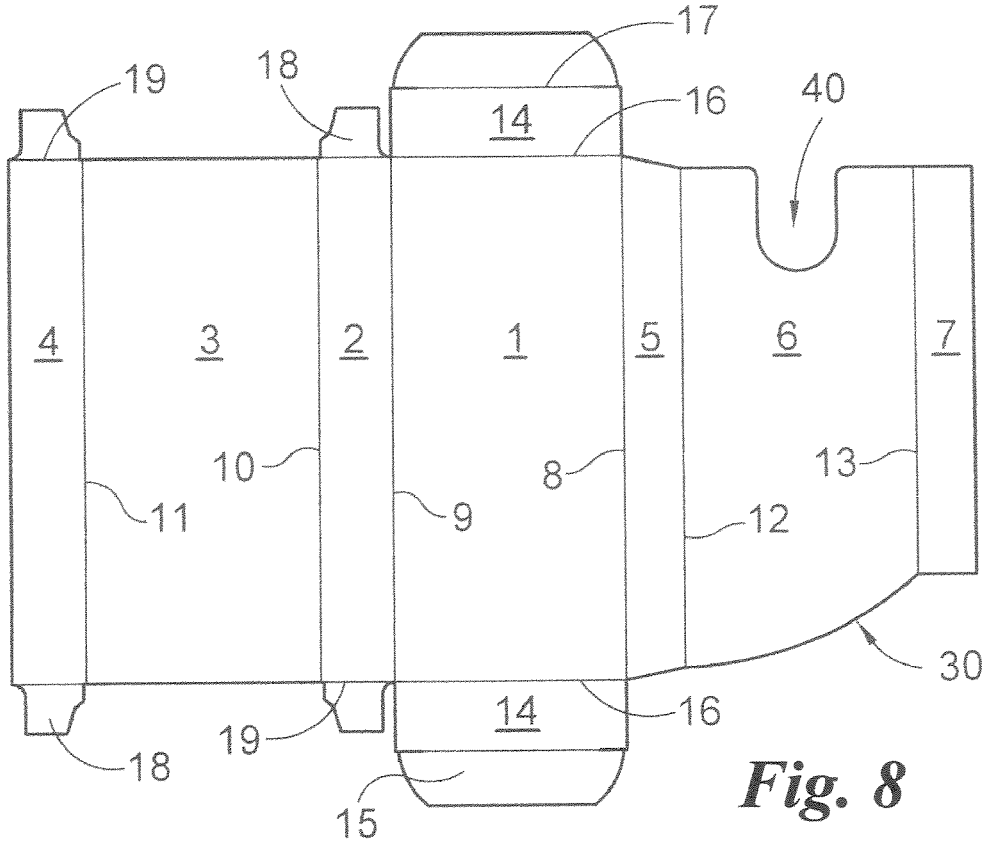
Figure 9:
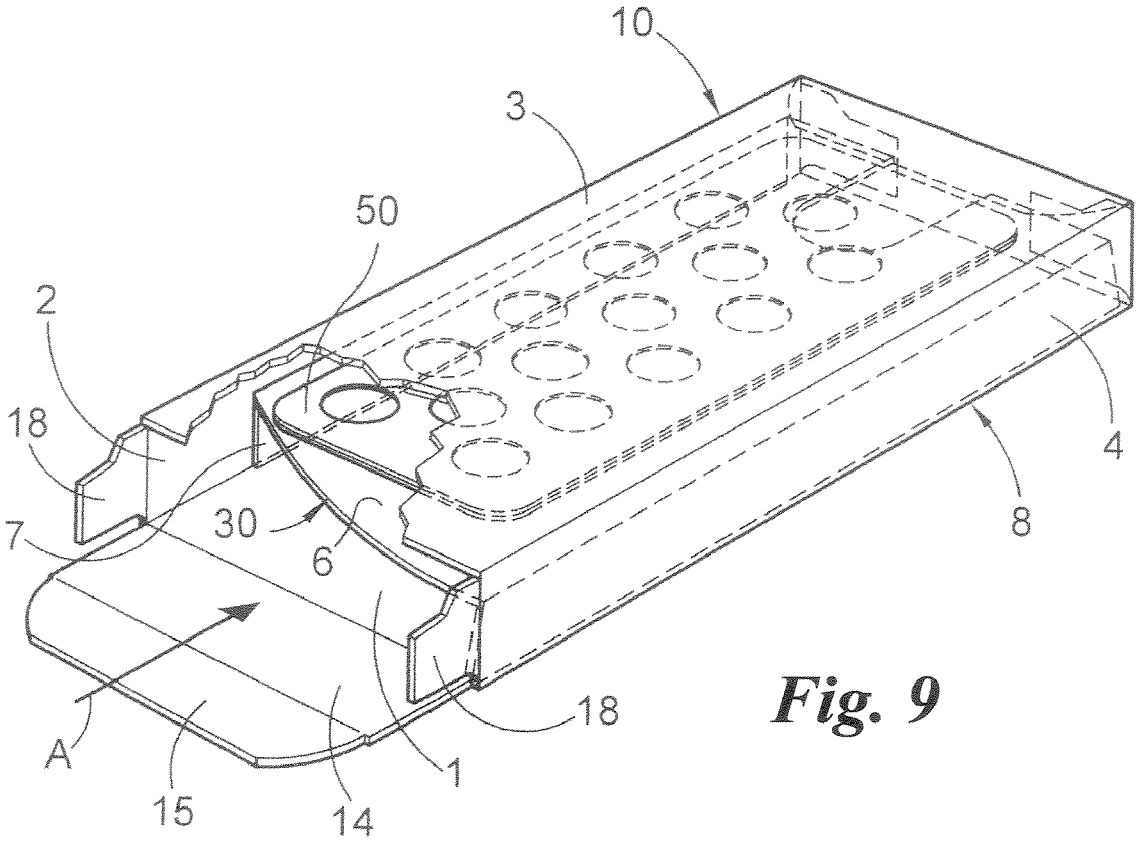

FIGS. from 2 to 5 show this piece of cardboard in its successive steps of folding and gluing to form a finished box, ready for despatch to a box utilization firm;

FIG. 6 is a perspective view (with some parts removed for greater image clarity) of one end of a box, with its lid open, as it is presented at the moment in which an automatic machine (not shown) of a user firm is about to introduce a product (for example a bottle or blister sheets of medicaments or other types of products) into it through the open end of the lid;

FIG. 7 is a cross-section through the box on the line 7-7 of FIG. 6;

FIG. 8 is similar to FIG. 1 but shows a different embodiment of the punched cardboard sheet in spread-out plan view; and FIG. 9 is a perspective view of one end of a box obtained from the cardboard sheet of FIG. 8.

DETAILED DESCRIPTION OF THE INVENTION

FIG. 1 shows in spread-out plan view a piece of punched and crease-lined cardboard comprising four main panels 1-4, two secondary panels 5, 6 and an end panel 7, which are consecutive and project from the main panel 1, said panels 1-7 being separated from each other by parallel longitudinal folding lines 8-13. From both ends of the panel 1 there projects a closure panel 14 from which a lip 15 divided from it by a transverse folding line 17 extends, flaps 18 projecting from both ends of the panels 2, 4: the closure panel 14 and the flaps 18 are divided from the respective main panels by transverse folding lines 16, 19 parallel to the folding line 17 and perpendicular to the longitudinal folding lines 8, 13.

It is important to note that the closure panels 14 project from the ends of the first main panel 1, from one side of which there extend the secondary panels 5, 6 and from the other side of which there extend the other main panels 2-4. It is also important that both the secondary panel 5 and the end panel 7 are of lesser width than the width of that main panel 2 adjacent to the first main panel 1.

Figure 2:
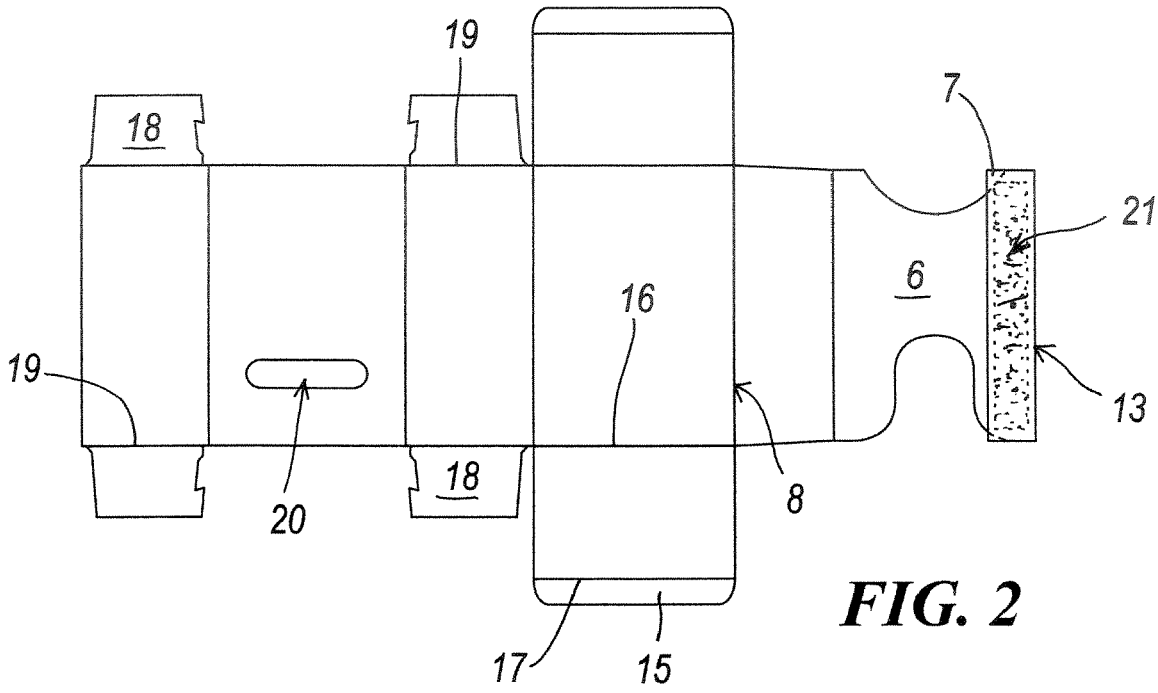
Figure 3:
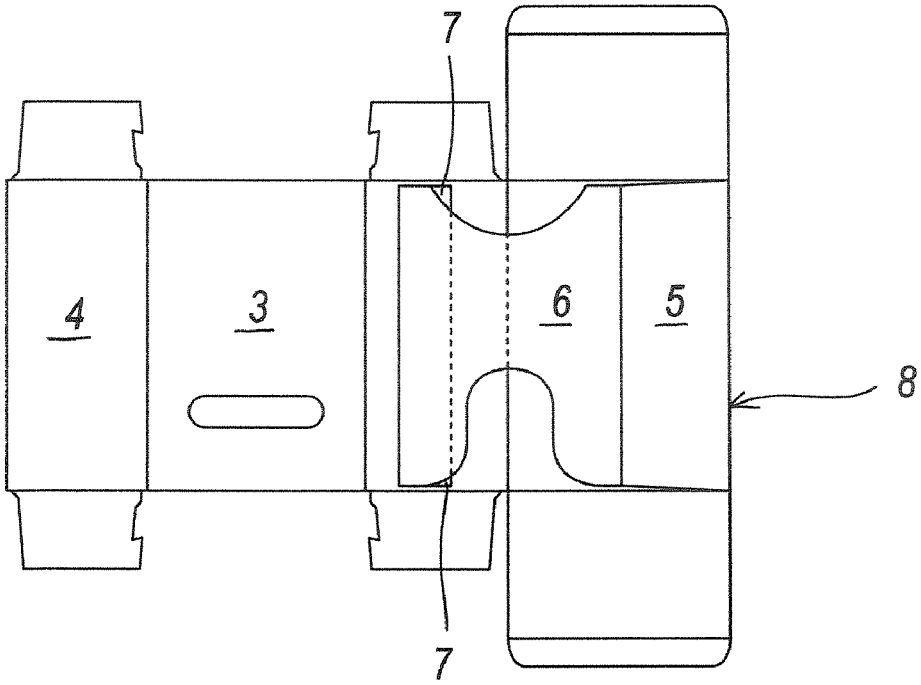

It will now be assumed that a box is to be shaped: the end panel 7 is firstly turned onto the secondary panel 6 (by rotating it about the folding line 13) and a strip of glue 21 is applied to that surface of the panel 7 facing upwards (FIG. 2). The panel 5 is then folded (about the folding line 8) so that it rests on the surface of the panel 1, while the panel 6 is rested partly on the said panel 1 and partly on the panel 2, the glue strip 21 causing the end panel 7 to firmly adhere to the panel 2 (FIG. 3).

Figure 4:
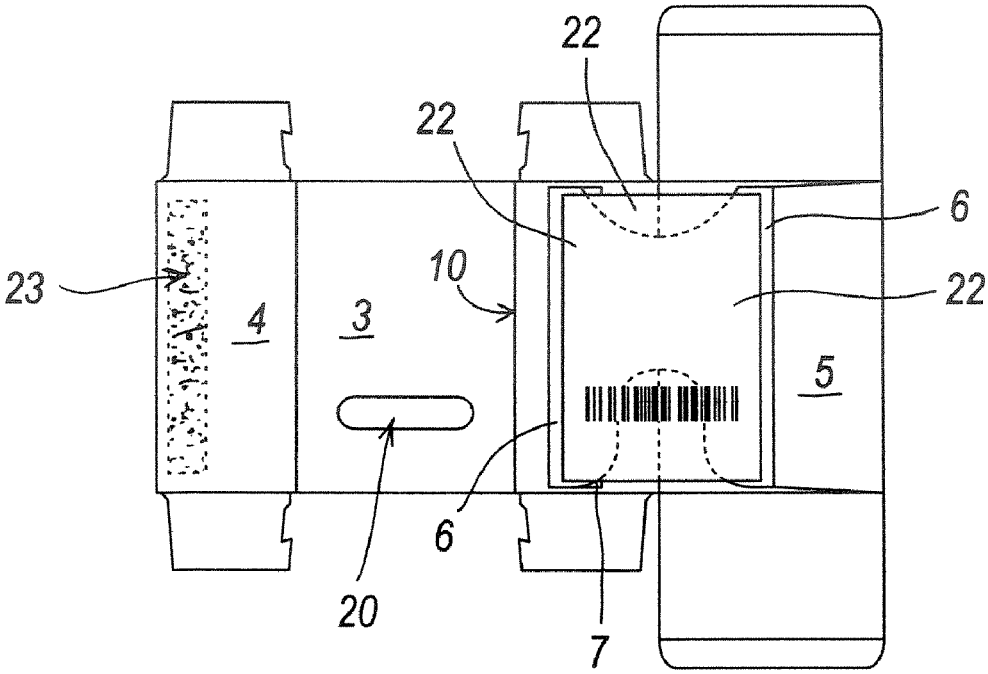

At this point an illustrative leaflet 22 already folded about itself or a blister sheet overwrapper or protector 22, for example of the type illustrated in US2006/0102512A and in the corresponding EP1657184A is laid thereon (possibly fixing it thereat with a spot of glue, not shown in the drawings), and a glue strip 23 is applied in proximity to the free edge of the panel 4 (FIG. 4).

Figure 5:
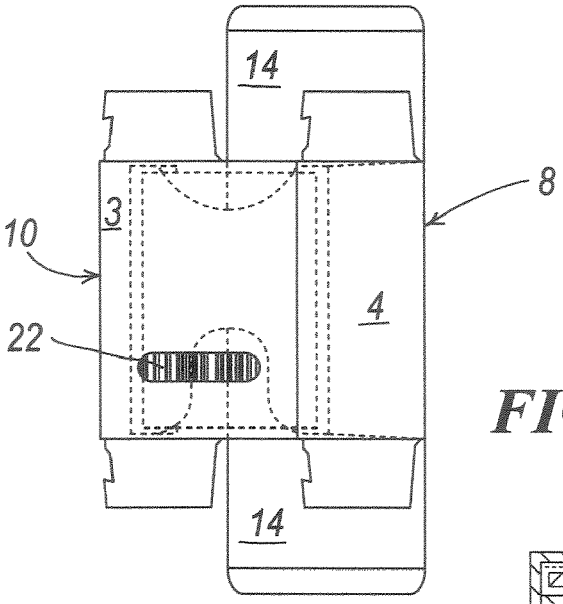

The panel 3 is then rotated about the folding line 10 until it is superposed on the illustrative leaflet (a portion thereof, on which a bar code carrying any desired useful information can be printed, being visible through an elongated window 20 provided in the panel 3), while the main panel 4 becomes superposed on and glued to the outer surface of the panel 5 (FIG. 5). The cardboard processing firm which has produced the box has thus terminated its work, and piles of boxes disposed as shown in FIG. 5 are despatched to the box user firms which, using automatic machines of known type operating at high speed, press the longitudinal ribs 8 and 10 towards each other to cause the box to assume the shape shown in FIG. 6 (in which it is assumed that the flaps 18 and the closure panel 14 with its lip 15 have in fact already been automatically closed, as happens for all boxes of this type).

In FIG. 6 the box, with its left end (relative to the Figure) completely open, with the main panel coplanar with the closure panel 14 and with the respective lip 15 extended and resting on a working surface T (which can be a portion of a conveyor belt or a different rigid surface), shows clearly that the pocket in which the illustrative leaflet 22 is housed (a portion of the box wall 3 has been removed, for greater drawing clarity) is disposed spaced apart from and on the opposite side to the wall 1 from which the closure panel projects (see the representation in FIG. 7 of the box shown on an enlarged scale in cross-section on the line 7-7 of FIG. 6) which is open, just as the flaps 18 are open.

It will be apparent that any type of product can be easily introduced into this box, in the direction of the arrow A (FIG. 6).

A bar code on the leaflet, visible through the window 20, allows automatic identification of any characteristic of the product to which the leaflet relates, even with the box closed.

Reference will now be made to FIG. 8 which shows a cardboard sheet very similar to the aforedescribed sheet shown in FIG. 1. For simplicity, FIG. 8 uses the same reference numerals already used in FIGS. 1-7 to indicate parts or elements of the cardboard sheet which are equal or similar in the two sheet embodiments, the only structural differences between the two cardboard sheets of FIGS. 1 and 8 being that in the embodiment of FIG. 8 the window 20 has been omitted, that in the embodiment of FIG. 8 the end panel 7 and the inner secondary panel 5 are of different lengths, and that at least one outer free edge 30 of the inner secondary panel 6 situated between the two panels 5 and 7 is inclined to the free edge of the main panel 3.

FIG. 8 also shows that a recess 40 is provided in the other free edge (the upper edge in FIG. 8) of the secondary panel 6.

The finished box obtained from the cardboard sheet of FIG. 8 assumes the shape shown in FIG. 9 (in which it is assumed that the flaps 18 and the closure panel 14 with its lip 15 present at one end of the box have in fact already been automatically closed, as happens for all boxes of this type).

In FIG. 9 the box, with its left end (relative to the figure) completely open (with a portion of the wall 3 removed for greater drawing clarity), and with the main panel coplanar to the closure panel 14 and to the respective lip 15, shows clearly that the pocket (in which a blister sheet protector 50 is shown instead of any illustrative leaflet) is disposed spaced apart from and on the opposite side to the wall 1 from which the closure panel 14, 15 projects.

It is apparent that, without any problem, any type of product (for example a plurality or a pack of blister sheets) can be introduced into this box in the direction of the arrow A (FIG. 9), without ever interfering with the pocket defined by the panel 6, the inclined or curved edge 30 of which facilitates any sliding and introduction of the product into the box which is to house and protect it.

The purpose of the recess 40 provided in the panel 6 is to enable the blister sheet protector 50 to be firmly gripped and extracted from the box through the closure panel 14 close to this recess 50.

What is claimed is:

1. A box comprising a plurality of main panels formed from a single piece of cardboard having in its interior a panel having two sides and two free end edges defining a pocket for housing an illustrative leaflet and also having a closure panel for closing at least one end of the box, the closure panel projecting from one end of one of the main panels, and being rotatable between a box open position and a box closed position, wherein the pocket is positioned in proximity to another main panel having a free end edge opposite the panel from which the closure panel extends, wherein the panel defining the pocket inside the box has the free end edges inclined with respect to the adjacent free end edge of the another main panel with which it defines the pocket, one of the free end edges having a recess therein and the other of the free end edges being curved from one side to the other whereby one side is more narrow than the other, and wherein the panel defining the pocket inside the box is disposed parallel to the another main panel with which the panel defines the pocket.

2. The box accordingly to claim 1, wherein the pocket is disposed in the box spaced apart from and on an opposite side of the box from the panel from which the closure panel extends.

3. A box comprising:

a plurality of main panels formed from a single piece of cardboard, the plurality of main panels being folded so as to define an interior of the box;

a closure panel that is configured to close at least one end of the box, the closure panel projecting from a first end of a first main panel of the plurality of main panels, and being rotatable between a box open position and a box closed position; and a secondary panel that includes two fixed side edges and two free end edges, the secondary panel being positioned in the interior of the box so as to define a pocket between the secondary panel and a second main panel of the plurality of main panels, the second main panel including a free end edge and being positioned on an opposite side of the box from the first panel such that the pocket is disposed in the box spaced apart from and on an opposite side of the box from the first panel, the pocket being configured to house an illustrative leaflet, wherein a first one of the two free end edges of the secondary panel includes a recess therein and a second one of the two free end edges of the secondary panel is inclined with respect to the free end edge of the second main panel, wherein the second one of the two free end edges is defined by a curve that extends from a first side of the secondary panel to a second side of the secondary panel such that the first side of the secondary panel is shorter than the second side of the secondary panel, and wherein the secondary panel is disposed in the interior of the box so as to extend substantially parallel to the second main panel.

* * * * *